US008772970B2

(12) United States Patent
Lambrou

(10) Patent No.: US 8,772,970 B2
(45) Date of Patent: Jul. 8, 2014

(54) LOCK ARRANGEMENT AND A METHOD OF PROVIDING POWER TO A LOCK

(75) Inventor: Harry Lambrou, Blackburn (AU)

(73) Assignee: Gainsborough Hardware Industries Limited, Blackburn, Victoria (AU)

( * ) Notice: Subject to any disclaimer, the term of this patent is extended or adjusted under 35 U.S.C. 154(b) by 957 days.

(21) Appl. No.: 12/309,566

(22) PCT Filed: Jul. 10, 2007

(86) PCT No.: PCT/AU2007/000944
§ 371 (c)(1),
(2), (4) Date: Aug. 25, 2009

(87) PCT Pub. No.: WO2008/011657
PCT Pub. Date: Jan. 31, 2008

(65) Prior Publication Data

US 2009/0308116 A1 Dec. 17, 2009

(30) Foreign Application Priority Data

Jul. 27, 2006 (AU) ..... 2006904075

(51) Int. Cl.
*E05B 47/00* (2006.01)

(52) U.S. Cl.
USPC ..... 307/104

(58) Field of Classification Search
USPC ..... 307/104
See application file for complete search history.

(56) References Cited

U.S. PATENT DOCUMENTS

| | | | | |
|---|---|---|---|---|
| 6,011,320 | A * | 1/2000 | Miyamoto et al. | 307/10.2 |
| 2002/0117896 | A1 * | 8/2002 | Gohara | 307/10.1 |
| 2004/0183652 | A1 | 9/2004 | Deng et al. | |

FOREIGN PATENT DOCUMENTS

| | | | |
|---|---|---|---|
| AU | 199852770 | A1 | 7/1997 |
| DE | 36 12761 | A1 | 10/1987 |
| WO | WO 00/77330 | A1 | 12/2000 |
| WO | WO 02/077399 | A1 | 10/2002 |
| WO | WO 2006/006834 | A1 | 1/2006 |

* cited by examiner

*Primary Examiner* — Hal Kaplan
(74) *Attorney, Agent, or Firm* — Brinks Gilson & Lione

(57) ABSTRACT

A lock arrangement including an electrically powered lock actuator, a power receiver (30) and a power transmitter (18). The electrically powered lock actuator is adapted for mounting in or on a door (10). The power receiver (30) is adapted for mounting in or on the door (10) in electrical connection with the lock actuator. The power transmitter (18) is adapted for mounting adjacent the door (10) and for transmitting power across an air gap to the power receiver (30).

26 Claims, 7 Drawing Sheets

LOCK ARRANGEMENT AND A METHOD OF PROVIDING POWER TO A LOCK

CROSS REFERENCE TO RELATED APPLICATIONS

This application claims priority to Australian provisional application no. 2006904075, filed Jul. 27, 2006, the entire contents of which are incorporated herein by reference.

FIELD OF THE INVENTION

The present invention relates generally to a lock arrangement and, more particularly, to an electrically powered lock arrangement and a method of providing power to such a lock arrangement.

The invention has been primarily developed for use in domestic doors. However, the invention is not limited to this particular field of use and is equally suited for any application involving a lock that can be driven by an electrically powered lock actuator.

BACKGROUND OF THE INVENTION

Several ways of electrically powering door locks are known. One such way of powering a lock uses a battery to power the lock actuator. The batteries are positioned in the door or in the door furniture that is mounted on the door. A disadvantage of this arrangement is that the lock operation is dependent on battery life and, as a result, battery failure can lead to lock-in, lock-out or loss of security.

An alternative arrangement involves connecting electricity to an actuator via a hinge, known as a Power Hinge. A disadvantage of this arrangement is that such hinges are expensive and tend to have a limited life. This arrangement also requires a door with the capability for concealed wiring, which also adds expense.

Another approach involves connecting an external power cable to a door. This is unsightly and a door with the capability for concealed wiring is still required. This approach is also only slightly less expensive than the Power Hinge arrangement.

It is an object of the present invention to substantially overcome or at least ameliorate one or more of the above prior art deficiencies.

SUMMARY OF THE INVENTION

Accordingly, in a first aspect, the present invention provides a lock arrangement including:

- an electrically powered lock actuator adapted for mounting in or on a door;
- a power receiver adapted for mounting in or on the door in electrical connection with the lock actuator; and
- a power transmitter adapted for mounting adjacent the door and for transmitting power across an air gap to the power receiver.

The lock arrangement preferably includes a mechanical lock and/or latch mechanism adapted for movement in response to movement of the lock actuator.

In one embodiment, the power receiver powers the lock actuator. In another embodiment, the power receiver charges an energy storage device, most preferably a battery, which powers the lock actuator. In yet another embodiment, the power receiver powers the lock actuator and charges an energy storage device, most preferably a battery, as a backup power source for the lock actuator.

The power transmitter and the power receiver are preferably mounted in close proximity to one another, with the minimum air gap between them sufficient to maintain door function. The air gap is preferably between 5 and 10 mm, most preferably 7 mm.

The power transmitter is preferably mounted to a door frame or wall adjacent the door, most preferably to the edge of the wall facing the door face where the lock is installed. The power transmitter is preferably mounted in a recess formed in the door frame.

The power receiver is preferably mounted to the door, most preferably to the edge of the door. The power receiver is preferably mounted in a recess formed in the edge of the door, most preferably adjacent the lock.

The electrically powered lock actuator is preferably a solenoid or motor or other electro-motional transducers.

The lock arrangement preferably includes means adapted for embedding control signals, for operating the lock actuator, into the power transmitted from the power transmitter to the power receiver. The control signal embedding means are preferably adapted to issue control signals in response to receiving a signal indicative of requiring the lock and/or latch mechanism to be unlocked or unlatched from a card reader, remote control, RFID or the like.

The power transmitter is preferably formed using a core with a wire coil formed thereon. The power receiver is preferably formed using a core with a wire coil formed thereon. The magnetic axes of the power transmitter and the power receiver are preferably parallel or aligned when the door is closed to optimise magnetic coupling therebetween. Different arrangements of the cores may impose different configurations for optimal coupling.

In a second aspect, the present invention provides a method of providing power to a electrically powered lock actuator mounted in or on a door, the method including the steps of:

- supplying power to a power transmitter mounted adjacent the door;
- transmitting power from the power transmitter across an air gap to a power receiver mounted in or on the door; and
- supplying power from the power receiver to the lock actuator.

In one embodiment, power is supplied directly from the power receiver to the lock actuator. In another embodiment, power is supplied from the power receiver to an energy storage device, most preferably a battery, which supplies power directly to the lock actuator. In yet another embodiment, power is supplied from the power receiver to the lock actuator and also charges an energy storage device, most preferably a battery, as a backup power source for the lock actuator.

Accordingly, in a third aspect, the present invention provides a lock arrangement including:

- an electrically powered lock actuator adapted for mounting in or on a door;
- a first electrical contact adapted for mounting in or on the door in electrical connection with the lock actuator; and
- a second electrical contact adapted for mounting adjacent the door such that, when the door is closed, the first and second electrical contacts are in power transmitting contact with one another.

In one embodiment, the first and second electrical contacts are in the form of a first pair and second pair of terminals (positive and negative). In another embodiment, the first and second electrical contacts are in the form of a first and second terminals, which share a common earth or ground.

In a fourth aspect, the present invention provides a method of providing power to a electrically powered lock actuator mounted in or on a door, the method including the steps of:

supplying power to a first contact mounted adjacent the door;

closing the door to bring a second contact mounted on in the door into power transmitting contact with the first contact; and supplying power from the second contact to the lock actuator.

The first and second electrical contacts are preferably in the form of a first pair and second pair of terminals (positive and negative) forming a complete circuit.

In a fifth aspect, the present invention provides a power transmission arrangement for transmitting power across an air gap, the arrangement comprising:

a power receiver, comprising a core with a wire coil formed thereon, on one side of the air gap, the power receiver coil having a magnetic axis; and a power transmitter, comprising a core with a wire coil formed thereon, on the other side of the air gap, the power transmitter coil having a magnetic axis, wherein the magnetic axes of the power transmitter core and the power receiver core are parallel or aligned to optimise magnetic coupling therebetween.

DETAILED DESCRIPTION OF THE PREFERRED EMBODIMENT

Figure 1:
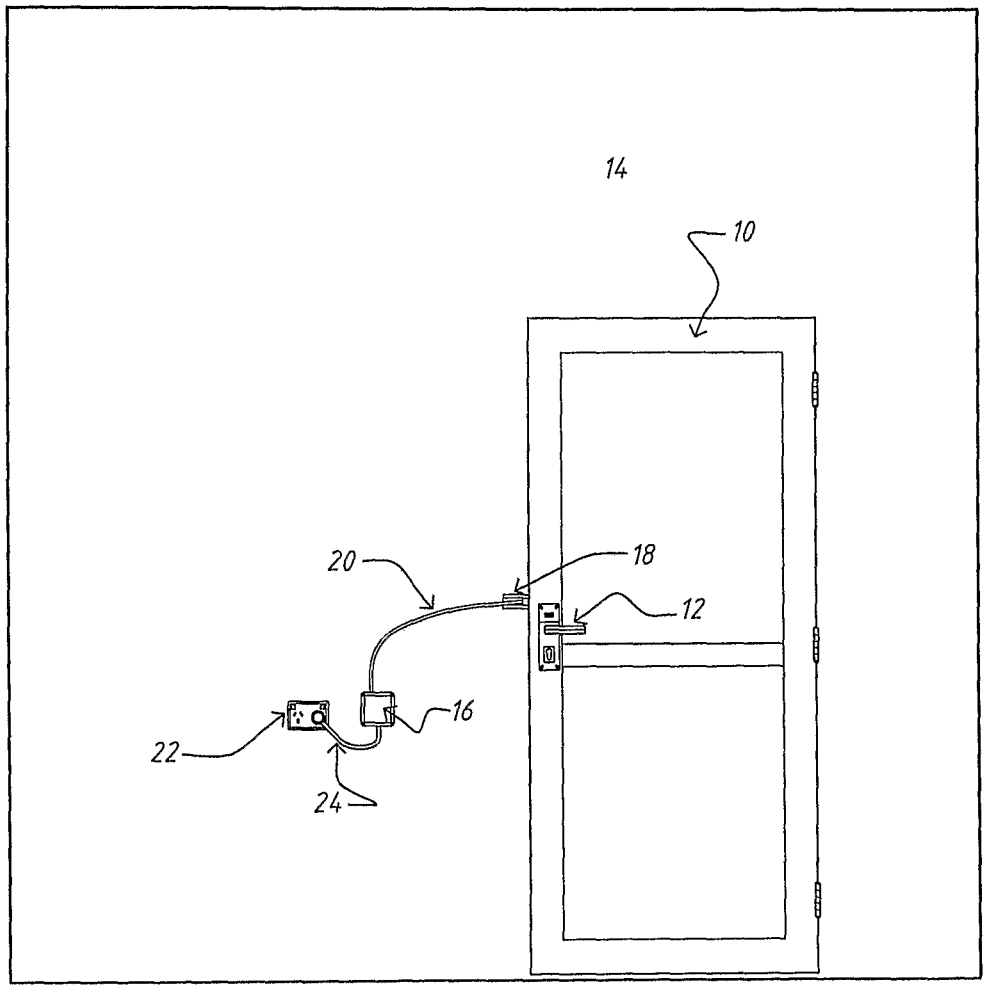
FIG. 1 is a front view of a door installation utilizing a lock arrangement according to a first embodiment of the invention.

Turning firstly to FIG. 1, there is shown a door 10 with a lock and latch mechanism 12. The door 10 is mounted in a wall 14. Also shown is a control box 16 which is connected to a power transmitter 18 by a line 20, and to a power source, in the form of a mains socket 22, by a line 24. The control box 16 and the power transmitter 18 form part of a first embodiment of an electrically powered lock arrangement that shall be described in more detail below. The control box 16 can alternatively be integrated into the same housing as the power transmitter 18.

Figure 2:
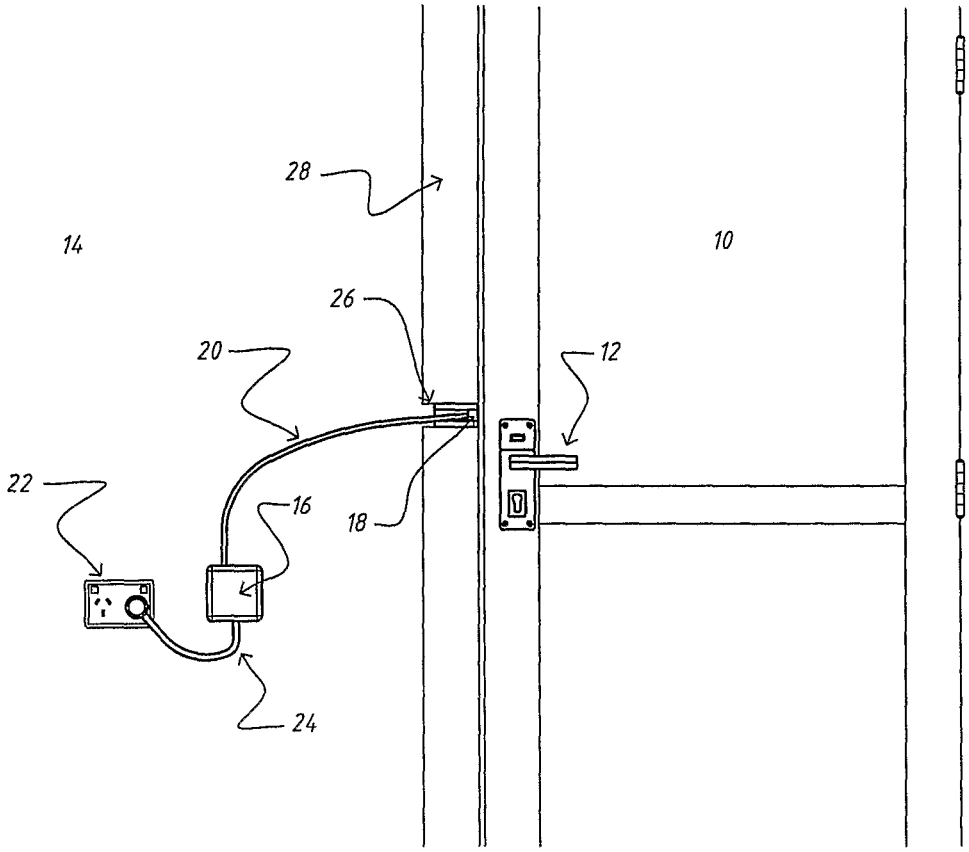
FIG. 2 is an enlarged detailed front view of the lock installation shown in FIG. 1.

FIG. 2 is an enlarged, more detailed, view of the components shown in FIG. 1 and, in particular, shows that the power transmitter 18 is positioned within a recess 26 within a door frame 28. The distal end of the power transmitter 18 is substantially flush with the edge of the door frame 28 facing the edge of the door 10 that contains the lock and latch mechanism 12.

Figure 3:
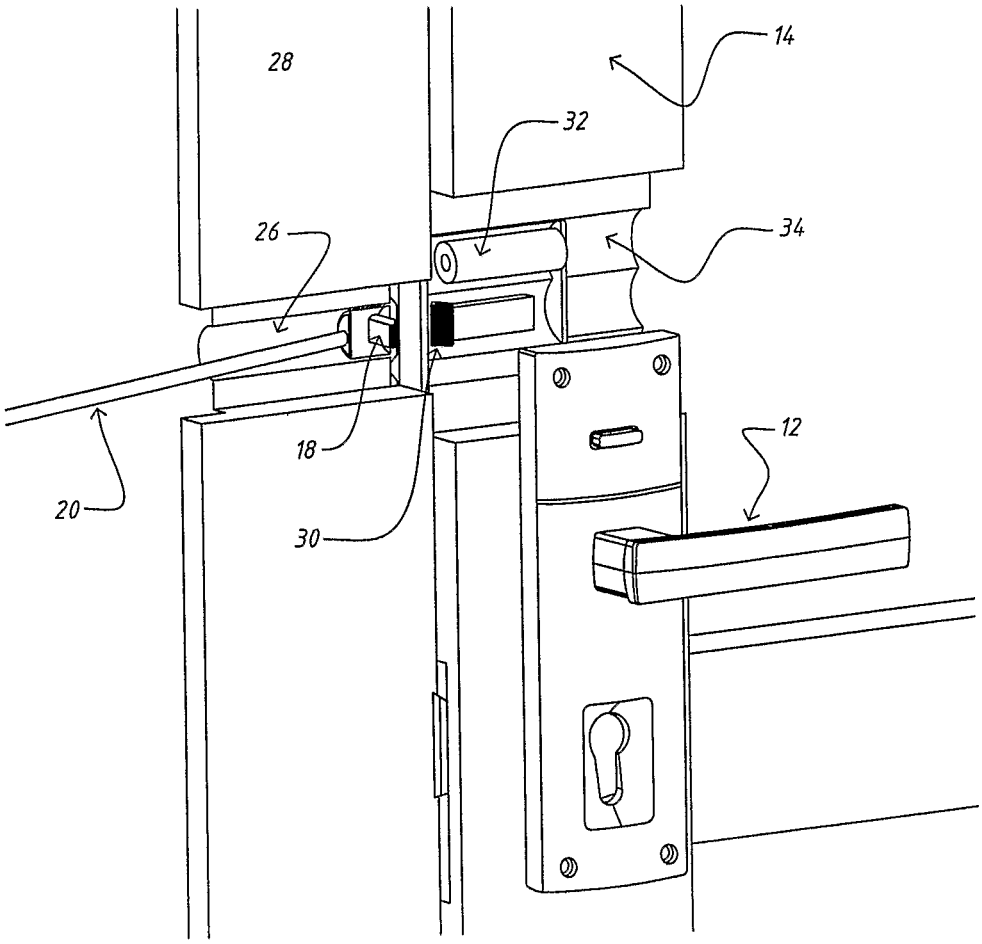
FIG. 3 is a further enlarged detailed perspective view of the lock arrangement shown in FIG. 2.

FIG. 3 shows the previously described components in even more detail and also shows a power receiver 30 and a battery 32. The receiver 30 and the battery 32 are mounted within a recess 34 in the door 10 with the distal end of the receiver 30 substantially flush with the edge of the door facing the door frame 28. The power receiver 30 and the battery 32 also form part of the first embodiment of the electrically powered lock arrangement. The battery 32 can alternatively be housed in the lock and latch mechanism 12.

Figure 4:
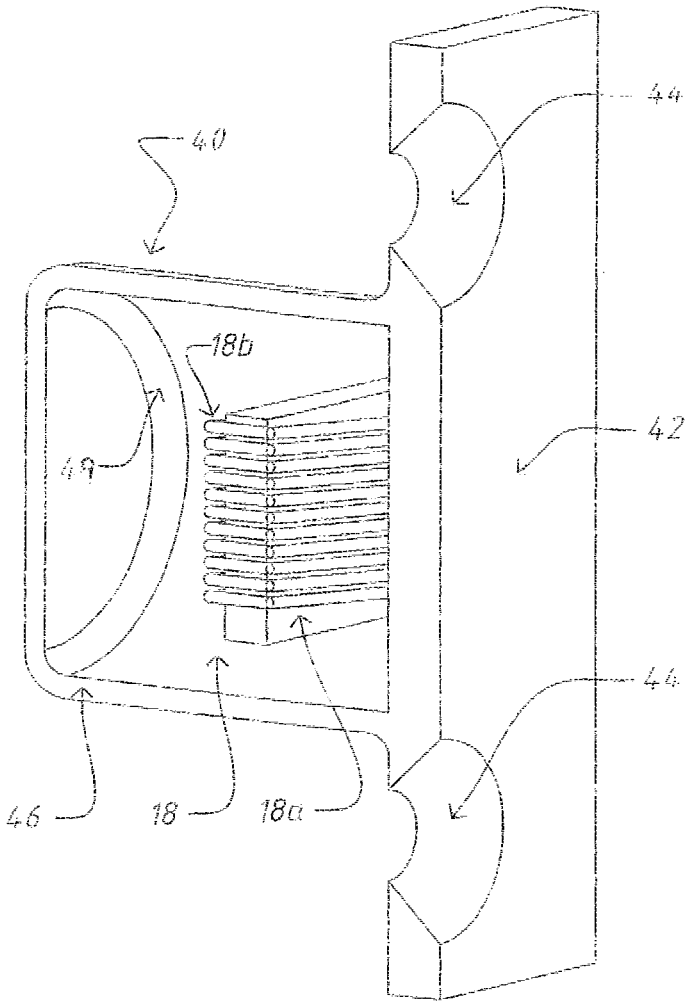
FIG. 4 is a partial cut away view of a power transmitter used in the lock arrangement shown in FIGS. 1 to 3.

FIG. 4 shows the power transmitter 18, which comprises an electromagnetic core 18*a* of, for example, ferrite material (comprised mainly of MnZn) with a wire coil 18*b* formed thereon. The power transmitter 18 is mounted within a plastic housing 40 that includes a face plate 42 with two openings 44 therein. The openings 44 are adapted to receive counter-sunk screws to attach the housing 40 to the door frame 28 The housing 40 also includes a cylindrical enclosure 45 for housing the power transmitter 18, which has an open end 49 to allow connection of the line 20 to the power transmitter 18.

Figure 5:
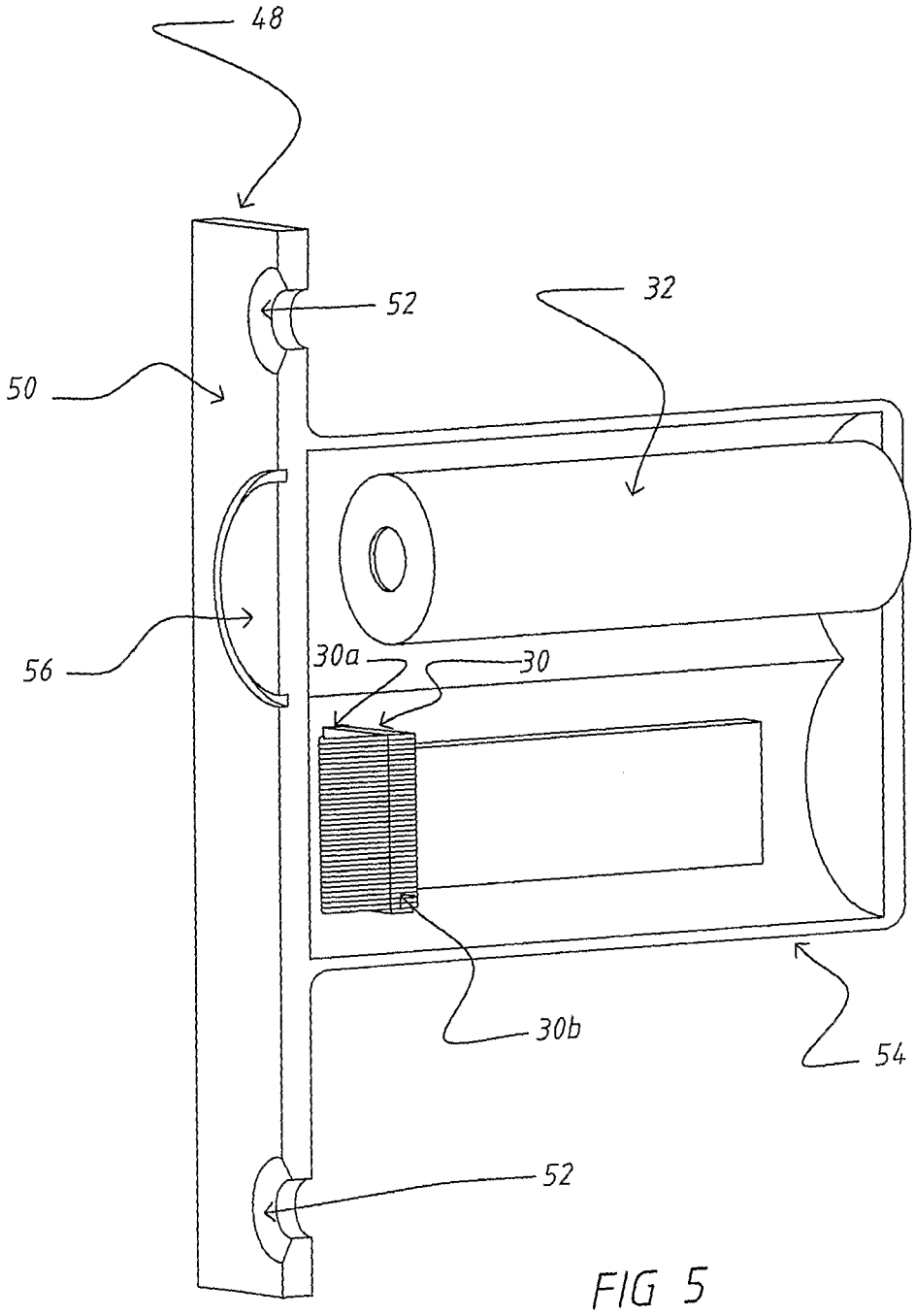
FIG. 5 is a partial cut away view of a power receiver used in the lock arrangement of FIGS. 1 to 3.

FIG. 5 shows a similar plastic housing 48 for the power receiver 30 and the battery 32 The power receiver 30 also comprises a core 30*a* with a wire coil 30*b* wound thereon. The housing 48 also includes a face plate 50 with a pair of openings 52 that are similarly adapted to receive counter-sunk mounting screws to attach the housing 48 to the door 10. The housing 48 also includes an enclosure 54 having a generally figure-of-8 cross-section for receiving the power receiver 30 and the battery 32 therein. The housing 49 also includes a removable cap 56 in order to provide access to the battery 32 for installation and/or replacement thereof.

Experiments by the present inventor indicate that the orientation and configuration of the cores 18*a* and 30*a* with their respective coils 18*b* and 30*b* as illustrated in FIGS. 4 and 5, affords significant magnetic coupling across the air gap between the door 10 and the wall 14. However, other orientations and configurations of the cores/coils can be used.

The operation of the electrically powered lock arrangement shall now be generally described. In use, mains power is provided through the line 24 (the control box may be designed to use mains power, a lower voltage source, or power supplied over the communications lines to the building controller, etc) to the control box 16. Power, and also embedded control signals, are then supplied to the power transmitter 18 via the line 20. When the door 10 is closed there is about a 7 mm air gap between the facing ends of the power transmitter 18 and the power receiver 30. The power and control signals cross the air gap between the power transmitter 18 and the power receiver 30. The power received by the power receiver 30 is then supplied to the battery 32, to maintain the charge in same. The battery 32 is then used to power a solenoid (or other electrical to mechanical actuator) which mechanically drives components of the (otherwise traditional) lock and latch mechanism 12. As an example, a solenoid can be used to drive a lever or pivot associated with the mechanism 12. Alternatively, an electric motor can be used to rotate a component of the mechanism 12 (such as a key cylinder) by virtue of a worm drive or like arrangement.

Control instructions indicative of requiring the lock and latch mechanism 12 to unlock or unlatch the door 10 are supplied to the control box 16 via a card reader, remote control RFID or other similar means (not shown) and then transmitted to the power receiver 18, and then to the lock actuator. The card reader, remote control RFID or other similar means are mounted on the wall 14 or the door frame 28. However, in an alternative arrangement, such access control means are mounted on the door 10 or the lock and latch mechanism 12. An advantage of the latter arrangement is that the lock/unlock signals etc do not need to be transmitted across the air gap, thereby improving security.

The power receiver 30 is also able to act as a signal transmitter and the power transmitter 18 is able to act as a signal receiver. This allows the power transmitter 18 to receive signals from the power receiver 30 and supply them to the control box 16. The signals are indicative of the lock and/or door status, for example: locked/unlocked; latched/unlatched; deadlocked/not-deadlocked; or door open/closed. Further, such signals would typically be encrypted.

An advantage of the first electrically powered lock arrangement embodiment described above is it is easily adaptable for all known mechanical lock types. Another advantage is it can be configured to allow manual key override. The lock arrangement also has the bulk of its electronics mounted on the wall (not the door) and thus only requires minor modification of the door when used with a traditional mechanical lock. More particularly, the lock components can be fitted into recesses formed in the edge of the door frame and door, which are familiar to lock installers. Further, the lock arrangement provides transmission of power and also control signals across a relatively large air gap between the door frame and the door, which makes it suitable for use in numerous installations and able to continue to function even if a door droops or otherwise becomes misaligned. Also, no Power Hinges or special doors, which are relatively expensive, are needed. A yet further advantage is, as the batteries are in the door, standard door furniture can be used. Finally, the electrically powered lock arrangement embodiment is not limited to an "inbuilt" access mechanism (swipe card etc.), which conveniently allows any control/security system to be adapted to it without extensive design modifications.

A more detailed description of the power and control componentry shall now be described with reference to FIG. 6.

Figure 6:
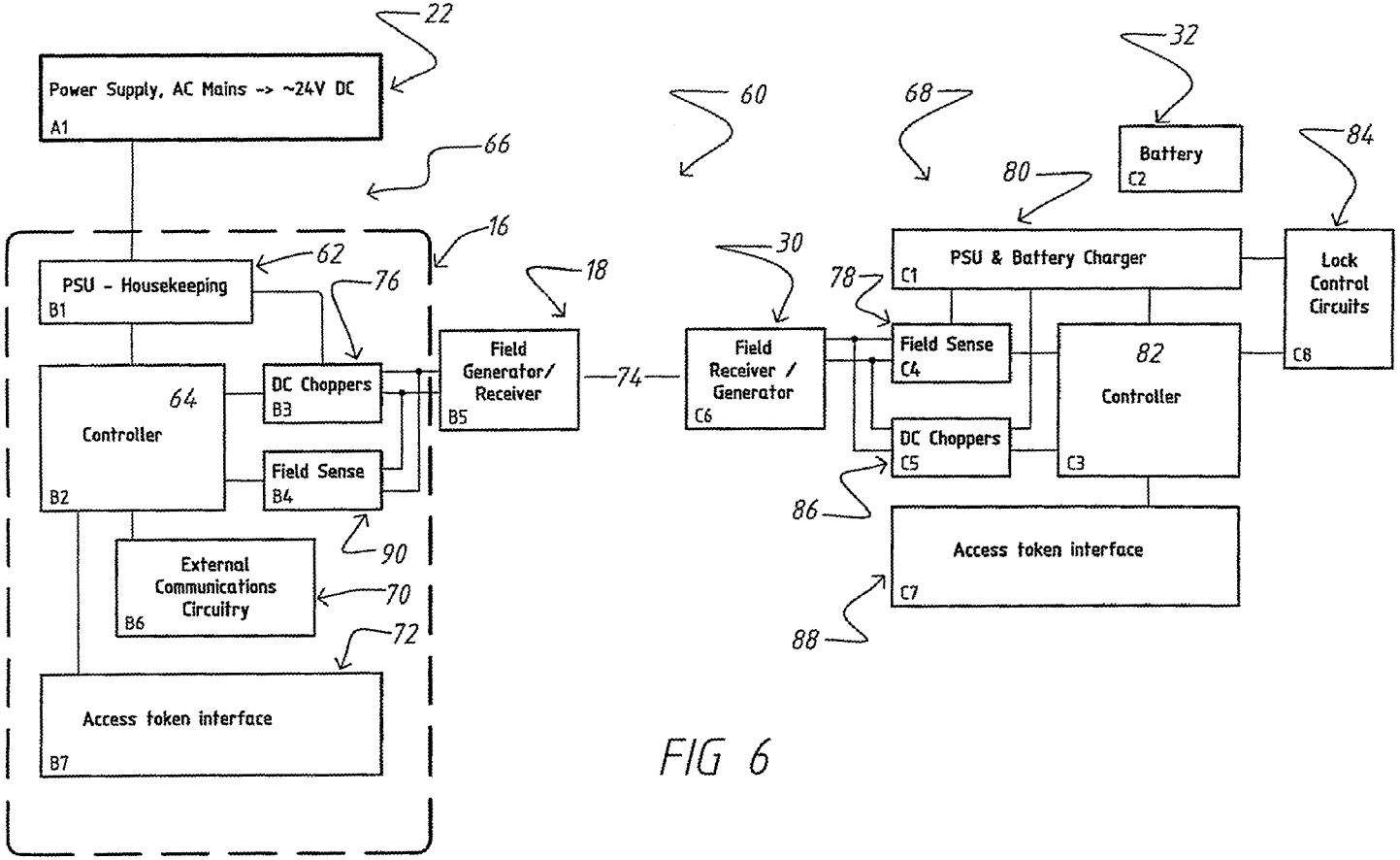
FIG. 6 is a schematic diagram of a control and power circuit utilized in the lock arrangement shown in FIGS. 1 to 5.

FIG. 6 shows an electrical circuit 60 of a preferred implementation of the first electrically powered lock arrangement embodiment. The power source 22 is used to derive power for the control box 16. The power source 22 directly couples to a mains supply such as 110 volts 60 cycles, or 230 volts 50 cycles. Alternatively, such may incorporate a so-called "plug back" transformer configured to convert the mains supply to a low voltage AC or DC supply. In a preferred implementation, a 24 volt DC supply is used. The power source 22 couples to a power supply unit 62 within the control box 16 which provides power supply conditioning and desired voltages to other components within the control box 16. A controller 64 operates to control power transfer from the frame side circuit 66 to the door side circuit 68 as well as permitting communication to a building/lock management system via an external communications interface 70. The controller 64 also permits communications to an access token interface device 72 which may be included within the control box 16 or configured external to the control box 16 at another location within the wall or door frame. The controller 64 is preferably configured using a microcontroller device. It is also operative to control uni-directional or bidirectional communications across the air gap 74 formed between the transmitter 18 and the receiver 30. In order to transfer power, the controller 64 directs DC chopper circuits 76 to provide power in an appropriate form to the field generator/receiver (ie. power transmitter) 18 which may be formed via a coil wound about a magnetic core, as described above for example. The rate and duration of power supplied via the DC choppers 76 is determined by the controller 64 and in the preferred configuration, the choppers 76 are also configured to recycle excess field energy at the end of each power application back into storage devices formed within the power supply unit 62.

The provision of power in an appropriate form to the generator/receiver 18 causes a field to be established across the air gap 74. Where the field generator 18 is an inductive device, such as a coil wound about a core, the field is magnetic and increases in strength as the duration of power application is increased. In an alternative implementation, an electric field may be used through the use of a capacitive generator resulting in capacitive (as opposed to magnetic) coupling.

Desirably, the field generator/receiver 18 supplies steady power transfer to the door module via an alternating (AC) magnetic field in which field generation parameters are steady and any artefacts in the field are also repetitive. Modulation of control parameters of the field by the controller 64 permit the field to be varied thus allowing communication signals to be transmitted across the air gap 74 from the frame side 66 to the door side 68.

The field emitted from the frame side 66 and transmitted across the air gap 74 is received by the field receiver/generator (ie. power receiver) 30 within the door 10. A field sense circuit 78 converts the received field into a power signal which is forwarded to a power supply unit and battery charger 80, and is used to charge the battery 32. As an alternative, a super capacitor or similar (non-battery) device may be substituted for the battery 32 to act as a reservoir of electrical energy for operation of the door side circuits 68. A control circuit 82 within the door side modules monitors the operation of the power supply and battery charger unit 80 and the field sense unit 78. The control circuit 82 also monitors and controls the operation of the lock control circuit 84 and is able to sense the position of the lock control circuit 84. With this sensing, the control circuit 82 is able to provide information to a DC chopper circuit 86 to enable the field receiver/generator 30 to communicate to the frame side circuit 66 across the air gap 74 to provide door lock status to the frame side circuit 66. The control circuit 82 also incorporates an interface 88 for an access token device permitting operation of the door lock control circuits 68. Other control means for actuating the door lock may be used such as a switched key lock or digital key pad. When the door module communicates its locking status, the DC choppers 86 generate a field, which is supplied to the field receiver/generator 30, which then emits a communication signal across the air gap 74 to the field generator/receiver 18. A field sense unit 90 within the control box 16 detects the communicating signal and supplies the same to the controller 64 which is able to thereby decode the communication signal and provide the door lock status via the external communication circuitry 70 to an interrogating device, such a building management unit.

Figure 7:
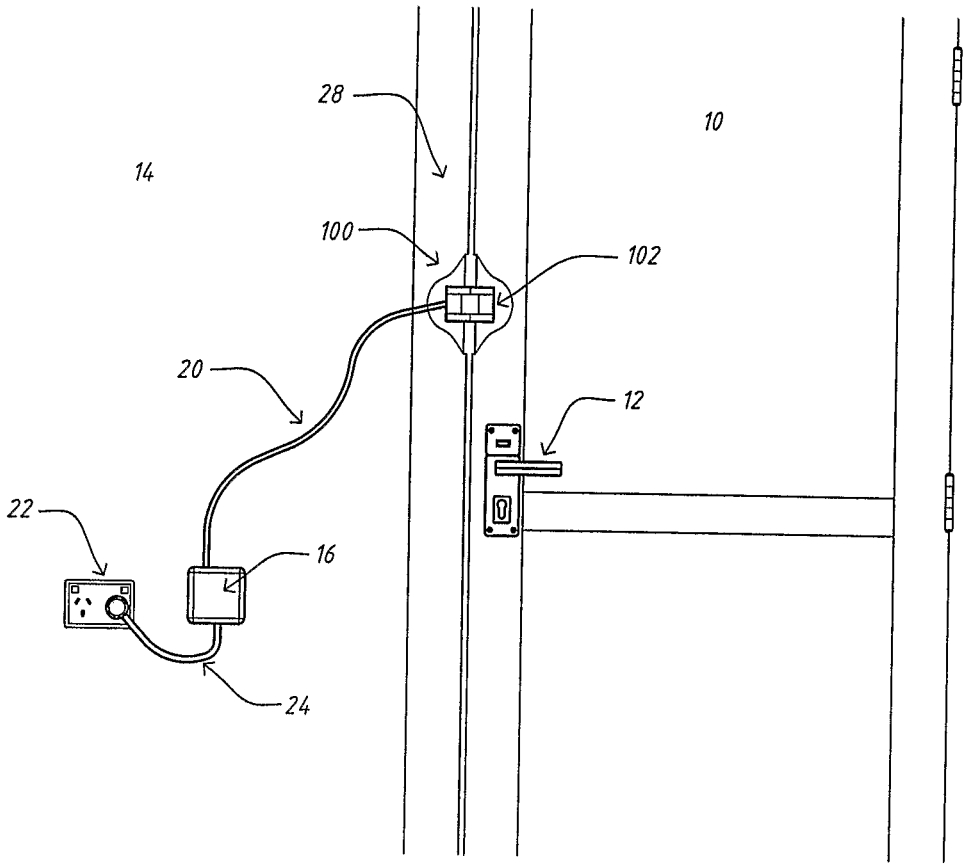
FIG. 7 is an enlarged detailed front view of a lock arrangement according to a second embodiment of the invention.

A second embodiment of lock arrangement is shown in FIG. 7. This lock arrangement is similar to that previously described except the power transmitter is replaced by a first pair of electrical contacts 100 mounted adjacent the door frame and the power receiver is replaced by a second pair of electrical contact 102 mounted adjacent the door edge. The contacts 100, 102 are mounted such that one or both of them protrude into the air gap between the door frame 28 and the edge of the door 10 and make contact when the door 10 is closed. This allows power, and also control signals, to be transmitted to the door mounted components, similar to that previously described.

Although the invention has been described with reference to preferred embodiments, it would be appreciated by persons skilled in the art that the invention may be embodied in many other forms.

The invention claimed is:

1. A lock arrangement including:

an electrically powered lock actuator adapted for mounting in or on a door;

a power receiver including a first core with a first wire coil formed thereon, the power receiver adapted for mounting in or on the door in electrical connection with the lock actuator; and a power transmitter including a second core with a second wire coil formed thereon, the power transmitter adapted for mounting adjacent the door and for transmitting power across an air gap to the power receiver, wherein the magnetic axes of the first and second cores are substantially parallel, and spaced apart, when the door is closed, wherein the first and second cores generate first and second magnetic fields respectively and the first and second magnetic fields overlap longitudinally in a direction normal to the magnetic axes of the first and second cores.

2. The lock arrangement as claimed in claim 1, further including a mechanical lock and/or latch mechanism adapted for movement in response to movement of the lock actuator.

3. The lock arrangement as claimed in claim 1, wherein the power receiver powers the lock actuator.

4. The lock arrangement as claimed in claim 1, wherein the power receiver charges an energy storage device, which powers the lock actuator.

5. The lock arrangement as claimed in claim 1, wherein the power receiver powers the lock actuator and charges an energy storage device, as a backup power source for the lock actuator.

6. The lock arrangement as claimed in claim 4, wherein the energy storage device is a battery.

7. The lock arrangement of claim 1, wherein the power transmitter and the power receiver are mounted in proximity to one another, with the minimum air gap between them sufficient to maintain door function.

8. The lock arrangement as claimed in claim 7, wherein the air gap is between 5 and 10 mm.

9. The lock arrangement as claimed in claim 8, wherein the air gap is approximately 7 mm.

10. The lock arrangement as claimed in claim 1, wherein the power transmitter is mounted to a door frame or wall adjacent the door.

11. The lock arrangement as claimed in claim 10, wherein the power transmitter is mounted to an edge of the wall facing the door face where the lock is installed.

12. The lock arrangement as claimed in claim 10, wherein the power transmitter is mounted in a recess formed in the door frame.

13. The lock arrangement as claimed in claim 1, wherein the power receiver is mounted to the door.

14. The lock arrangement as claimed in claim 13, wherein the power receiver is mounted to the edge of the door.

15. The lock arrangement as claimed in claim 13, wherein the power receiver is mounted in a recess formed in the edge of the door.

16. The lock arrangement as claimed in claim 13, wherein the power receiver is mounted in a recess formed in the edge of the door adjacent the lock.

17. The lock arrangement as claimed in claim 1, wherein the electrically powered lock actuator is a solenoid or motor or other electro-motional transducer.

18. The lock arrangement as claimed in claim 1, further including means adapted for embedding control signals, for operating the lock actuator, into the power transmitted from the power transmitter to the power receiver.

19. The lock arrangement as claimed in claim 18, wherein the control signal embedding means are adapted to issue control signals in response to receiving a signal indicative of requiring the lock and/or latch mechanism to be unlocked or unlatched from a card reader, remote control, or RFID.

20. The lock arrangement as claimed in claim 1, wherein a distance between the magnetic axes of the first and second cores in said normal direction is 3 to 10 mm.

21. A method of providing power to an electrically powered lock actuator mounted in or on a door, the method including the steps of:

supplying power to a power transmitter mounted adjacent the door, the power transmitter including a first core with a first wire coil formed thereon;

transmitting power from the power transmitter across an air gap to a power receiver mounted in or on the door, the power receiver including a second core with a second wire coil formed thereon, wherein respective longitudinal axis of the first and second cores are substantially parallel, and spaced apart, when the door is closed, wherein the first and second cores generate first and second magnetic fields respectively and the first and second magnetic fields overlap longitudinally in a direction normal to the magnetic axes of the first and second cores; and supplying power from the power receiver to the lock actuator.

22. The method as claimed in claim 21, wherein power is supplied directly from the power receiver to the lock actuator.

23. The method as claimed in claim 21, wherein power is supplied from the power receiver to an energy storage device, which supplies power directly to the lock actuator.

24. The method as claimed in claim 23, wherein the energy storage device is a battery.

25. The method as claimed in claim 21, wherein power is supplied from the power receiver to the lock actuator and also charges an energy storage device as a backup power source for the lock actuator.

26. The method as claimed in claim 25, wherein the energy storage device is a battery.

* * * * *